US009122198B2

(12) United States Patent
Senda et al.

(10) Patent No.: US 9,122,198 B2
(45) Date of Patent: Sep. 1, 2015

(54) DEVELOPING UNIT

(71) Applicants: Seiichi Senda, Anjo (JP); Shuichi Kato, Nagoya (JP); Masanari Yoshikawa, Nagoya (JP)

(72) Inventors: Seiichi Senda, Anjo (JP); Shuichi Kato, Nagoya (JP); Masanari Yoshikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/852,458

(22) Filed: Mar. 28, 2013

(65) Prior Publication Data

US 2013/0259540 A1 Oct. 3, 2013

(30) Foreign Application Priority Data

Mar. 30, 2012 (JP) ..... 2012-078991

(51) Int. Cl.
*G03G 15/08* (2006.01)

(52) U.S. Cl.
CPC ..... *G03G 15/0839* (2013.01); *G03G 15/0865* (2013.01); *G03G 15/0877* (2013.01); *G03G 15/0891* (2013.01); *G03G 15/0896* (2013.01)

(58) Field of Classification Search
USPC ..... 399/254, 281
See application file for complete search history.

(56) References Cited

U.S. PATENT DOCUMENTS

| | | | | |
|---|---|---|---|---|
| 5,539,502 | A | 7/1996 | Koshino et al. | |
| 7,860,437 | B2 | 12/2010 | Kakuta et al. | |
| 8,391,752 | B2 | 3/2013 | Sato | |
| 2006/0222414 | A1 | 10/2006 | Yamamura | |
| 2008/0247784 | A1 | 10/2008 | Kakuta et al. | |
| 2011/0076062 | A1 | 3/2011 | Kakuta et al. | |
| 2011/0103844 | A1 | 5/2011 | Sato | |
| 2012/0170955 | A1 | 7/2012 | Kakuta et al. | |
| 2013/0011163 | A1* | 1/2013 | Senda et al. | 399/254 |
| 2013/0223889 | A1 | 8/2013 | Kato | |

FOREIGN PATENT DOCUMENTS

| | | | |
|---|---|---|---|
| JP | 06-301284 | A | 10/1994 |
| JP | 07-333913 | A | 12/1995 |
| JP | 08-123180 | A | 5/1996 |
| JP | 08-160749 | A | 6/1996 |

(Continued)

OTHER PUBLICATIONS

Extended European Search Report issued in corresponding European Application No. 13160081.9, mailed Nov. 10, 2014.

(Continued)

*Primary Examiner* — Erika J Villaluna
(74) *Attorney, Agent, or Firm* — Banner & Witcoff, Ltd.

(57) ABSTRACT

There is provided a developing unit, including: a body defining a developing chamber and a developer accommodating chamber, and a developer delivery member. The body includes a sliding portion, a restoring portion and a colliding portion at the developer accommodating chamber. The developer delivery member includes an elastic member configured to be made a sliding contact with the sliding portion while being curved elastically, configured to be restored elastically at the restoring portion, and configured to collide with the colliding portion. The developer delivery member is configured so that, the elastic member which has been elastically restored at the restoring portion is collided with the colliding portion to generate an air flow and to deliver the developer in the developer accommodating chamber toward the connection port.

12 Claims, 7 Drawing Sheets

(56) References Cited

FOREIGN PATENT DOCUMENTS

| | | | |
|---|---|---|---|
| JP | H11-102104 | A | 4/1999 |
| JP | 2008-170951 | A | 7/2008 |
| JP | 2008-250290 | A | 10/2008 |
| JP | 2010-197972 | A | 9/2010 |
| JP | 2011-022395 | A | 2/2011 |
| JP | 2011-095578 | A | 5/2011 |
| JP | 2013-037343 | | 2/2013 |
| JP | 2013-178413 | | 9/2013 |

OTHER PUBLICATIONS

English translation of pp. 3-4 of the Chinese Notification of First Office Action—App 201310098192.X dated Apr. 28, 2015.

Apr. 28, 2015—(CN) Notification of First Office Action—App 201310098192.X.

* cited by examiner

DEVELOPING UNIT

CROSS REFERENCE TO RELATED APPLICATION

The present application claims priority from Japanese Patent Application No. 2012-078991 filed on Mar. 30, 2012, the disclosure of which is incorporated herein by reference in its entirety.

BACKGROUND OF THE INVENTION

1. Field of the Invention

The present invention relates to a developing unit of an image forming apparatus including a developer container.

2. Description of the Related Art

A developing unit, which is provided in an image forming apparatus such as a laser printer and a digital copying machine, is generally provided with a developer container containing a developer (toner) and a developing chamber to which the developer is delivered from the developer container. A developing roller which carries the developer on a circumferential surface thereof and a supply roller which supplies the developer to the circumferential surface of the developing roller are provided in the developing chamber.

As the developing container constructing this type of developing unit, for example, a developer container has been known in which a developer delivery member, which stirs the developer at a lower side of the developer container to deliver it to the developing chamber, is included. The developer delivery member is formed of a rotating base member (delivery support shaft) which rotates together with a rotational shaft and a body of the developer delivery member (sheet section) in which a base-end portion is fixed to the rotating base member and a front-end portion swings or rotates along an inner wall of the developer container. The body of the developer delivery member is formed of a plate-shaped elastic part so that the front-end portion thereof is moved slidably along the inner wall of the developer container while being curved or bended elastically.

SUMMARY OF THE INVENTION

In the above described developer container, the developer is supplied from a bottom portion of the developer container to the developing chamber against gravitational force. Thus, there is fear that the developer is not supplied uniformly to the developing chamber to cause imbalance of the developer. Further, due to the imbalance of the developer, there is fear that the developer is not supplied to the supply roller uniformly and that the developer is not carried by the developing roller uniformly, and thereby causing image forming failure in some cases.

In view of this, an object of the present teaching is to provide a developing unit of an image forming apparatus including a developer container, which is capable of improving a developer delivery capability of a developer delivery member delivering a developer and is capable of delivering the developer uniformly.

In order to solve the above problem, according to an aspect of the present teaching, there is provided a developing unit of an image forming apparatus, including:

a body defining a developing chamber and a developer accommodating chamber, the developing chamber being configured to accommodate a developing roller, and the developer accommodating chamber being configured to accommodate a developer and being connected to the developing chamber via a connection port, the body including a sliding portion, a restoring portion and a colliding portion at the developer accommodating chamber; and a developer delivery member arranged in the developer accommodating chamber and configured to rotate in a rotating direction so that the developer in the developer accommodating chamber is delivered to the developing chamber, the developer delivery member including an elastic member configured to be made a sliding contact with the sliding portion while being curved elastically, configured to be restored elastically at the restoring portion, and configured to collide with the colliding portion, wherein the sliding portion, the restoring portion and the colliding portion are arranged along the rotating direction, the connection port is located on an upstream side of the colliding portion in the rotating direction, and the developer delivery member is configured so that, the elastic member which has been elastically restored at the restoring portion is collided with the colliding portion to generate an air flow and to deliver the developer in the developer accommodating chamber toward the connection port.

In the developing unit, the elastic member swings or rotates around a rotational axis, thereby stirring the developer contained in the developer accommodating chamber. Further, the elastic member slidably moves to rotate along the sliding portion in a state of being elastically curved toward an upstream side (rear side) in the rotating direction and the elastic member is restored elastically in the developer delivery chamber due to elastic restoring force, thereby releasing the developer into the developer accommodating chamber. Then, the elastic member collides with the colliding portion, thereby generating the air flow to deliver the developer (delivery air flow). The developer released into the developer accommodating chamber is delivered by the delivery air flow to the connection port which is open on the upstream side of the colliding portion in the rotating direction of the elastic member. In this situation, since the elastic member collides with the colliding portion to expel air between the elastic member and the colliding portion upward, a strong delivery air flow which has high energy as the air flow to deliver the developer is generated.

DESCRIPTION OF THE PREFERRED EMBODIMENTS

Figure 1:
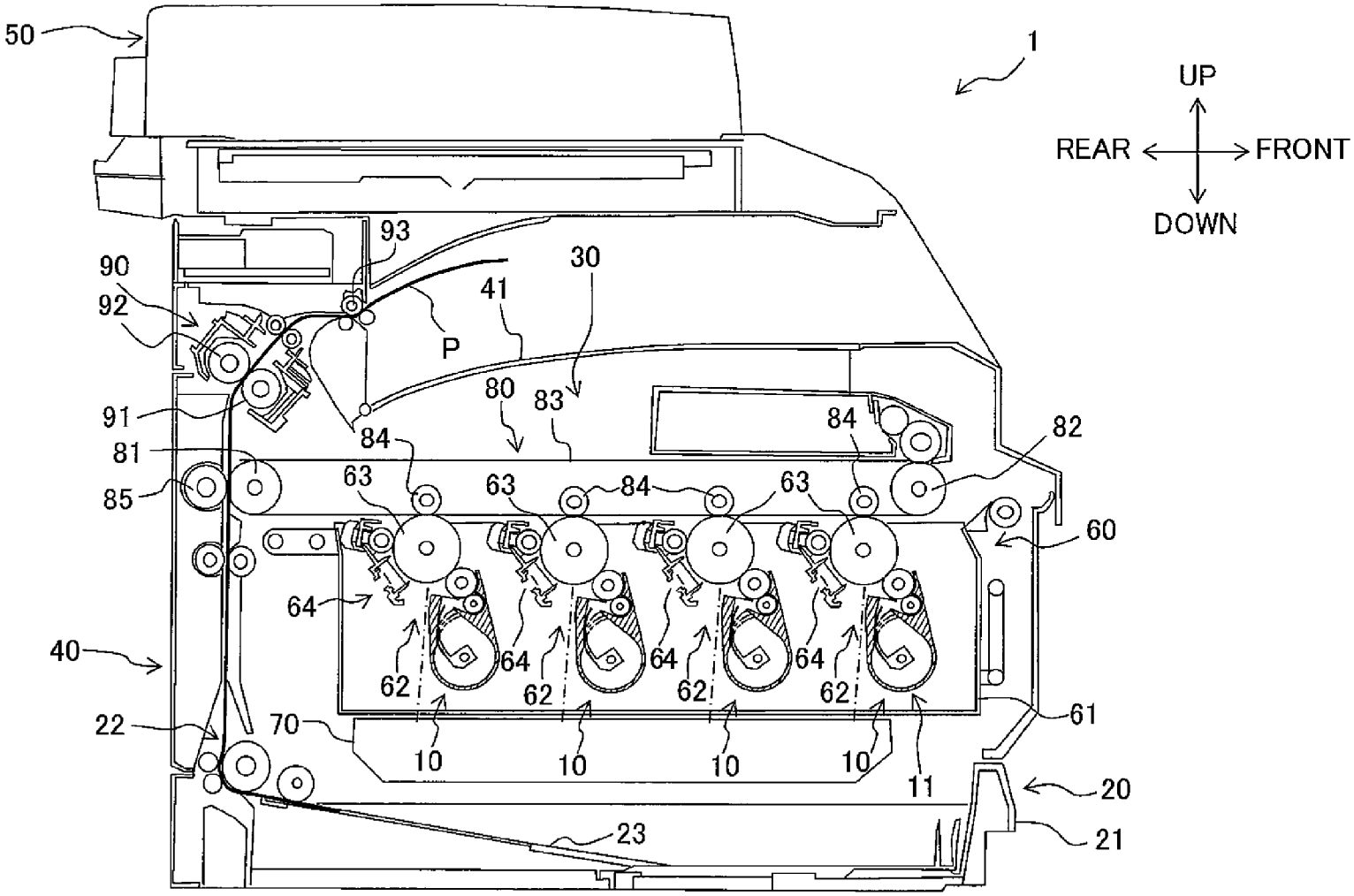
FIG. 1 is a side sectional view of a schematic structure of a laser printer as an image forming apparatus which is provided with a developer container according to an embodiment of the present teaching.

Next, an explanation will be made in detail with respect to an embodiment of a developer container according to the present teaching with reference to the drawings appropriately. The developer container of the embodiment constructs a developing unit of an image forming apparatus and is embodied, for example, as a main part of a developing cartridge (developing unit) 10 which is removably installed to a laser printer 1 (image forming apparatus) as shown in FIG. 1. In the following description, the left side of the paper surface of FIG. 1 is defined as "rear (backward)", the right side of the paper surface of FIG. 1 is defined as "front (forward)", and the up-down direction of the paper surface of FIG. 1 is defined as "up-down".

<Schematic Structure of Laser Printer>

As shown in FIG. 1, the laser printer 1 includes a paper feed section 20 configured to feed paper sheet(s) P, an image forming section 30 configured to form an image on the paper sheet P, and the like in a main body casing 4. Further, the laser printer 1 includes a flatbed scanner 50, configured to read or scan a document to generate image data, on the main body casing 4. The image forming section 30 includes a process section 60, an exposure section 70, a transfer section 80, a fixing section 90, and the like.

<Structure of Paper Feed Section>

The paper feed section 20 includes a paper feed tray 21 disposed at a lower portion of the main body casing 40, a paper feed mechanism 22 disposed on a rear side of the paper feed tray 21, and a paper pressing plate 23 by which each of the paper sheets P accommodated in the paper feed tray 21 is delivered to the paper feed mechanism 22. The rear of each paper sheet P accommodated in the paper feed tray 21 is lifted upward by the paper pressing plate 23, and the paper sheets P are separated one-by-one by the paper feed mechanism 22 to be transported upward.

<Structure of Process Section>

The process section 60 includes four process cartridges 62, each of which is accommodated in a holding case 61 and is arranged with a predetermined spacing distance in front and rear directions. Each of the process cartridges 62 is formed of a photosensitive drum 63 having a photosensitive layer formed on the surface thereof, a charger 64 by which the photosensitive layer of the photosensitive drum 63 is uniformly charged, and a developing cartridge 10 configured to a developer to the photosensitive layer of the photosensitive drum 63. The photosensitive drum 63 is arranged at the upper portion of the process cartridge 62, the charger 64 is arranged on the rear side of the photosensitive drum 63, and the developing cartridge 10 is arranged on the lower side of the photosensitive drum 63.

In each of the process cartridges 62, the photosensitive layer formed on the surface of the photosensitive drum 63 is uniformly charged by the charger 64, and then the photosensitive layer is exposed by high speed scanning with a laser beam emitted from the exposure section 70. By exposing the photosensitive layer as described above, an electrostatic latent image based on image data is formed on the surface of the photosensitive drum 63. Then, a toner, which is an example of the developer, is supplied from the developing cartridge 10 to the electrostatic latent image to form a toner image, in which the electrostatic latent image is visualized, on the surface of the photosensitive drum 63.

<Structure of Exposure Section>

The exposure section 70 is arranged above the paper feed section 20 and below the process section 60. The exposure section 70 includes a laser source, a polygon mirror, a lens, a reflecting mirror, and the like, those of which are not illustrated. In the exposure section 70, the laser beam emitted from the laser source is reflected at the polygon mirror and/or the reflecting mirror to illuminate the surface of the photosensitive drum 63, and the laser beam is subjected to the high speed scanning to expose the surface of the photosensitive drum 63.

<Structure of Transfer Section>

The transfer section 80 is disposed above the process section 60. The transfer section 80 includes a drive roller 81 arranged above the paper feed mechanism 22 disposed on the rear side of the main body casing 40, a driven roller 82 arranged on the front side of the main body casing 40, and an intermediate transfer belt 83 provided to span between the drive roller 81 and the driven roller 82.

The transfer section 80 includes four primary transfer rollers 84 and a secondary transfer roller 85, the four primary transfer rollers 84 being arranged inside a lower path line of the intermediate transfer belt 83 while facing the respective photosensitive drums 63 so that the intermediate transfer belt 83 is pressed onto the four photosensitive drums 63 of the four process cartridge 62, and the secondary transfer roller 85 being arranged to face the drive roller 81 so that the paper sheet P is pressed onto the intermediate transfer belt 83.

In the transfer section 80, the toner images of respective colors formed on the photosensitive layers on the surfaces of the four photosensitive drums 63 are transferred and superimposed in order on the intermediate transfer belt 83. Then, the paper sheet P transported upward from the paper feed mechanism 22 is pressed onto the intermediate transfer belt 83 by the secondary transfer roller 85 to transfer the toner images of respective colors transferred and superimposed on the intermediate transfer belt 83 on the paper sheet P.

<Structure of Fixing Section>

The fixing section 90 includes a heating roller 91 arranged above the drive roller 81 of the transfer section 80 and configured to heat the paper sheet P pressed by the secondary transfer roller 85 to be transported upward, and a pressurizing roller 92 arranged to face the heating roller 91 to press the paper sheet P onto the heating roller 91. In the fixing section 90, the toner images of respective colors transferred onto the paper sheet P from the intermediate transfer belt 83 are heated by the heating roller 91 to be thermally fixed. Then, the paper sheet P on which the toner images of respective colors have been thermally fixed is discharged on a paper discharge tray 42 by a paper discharge roller 93.

<Structure of Developing Cartridge>

Figure 2:
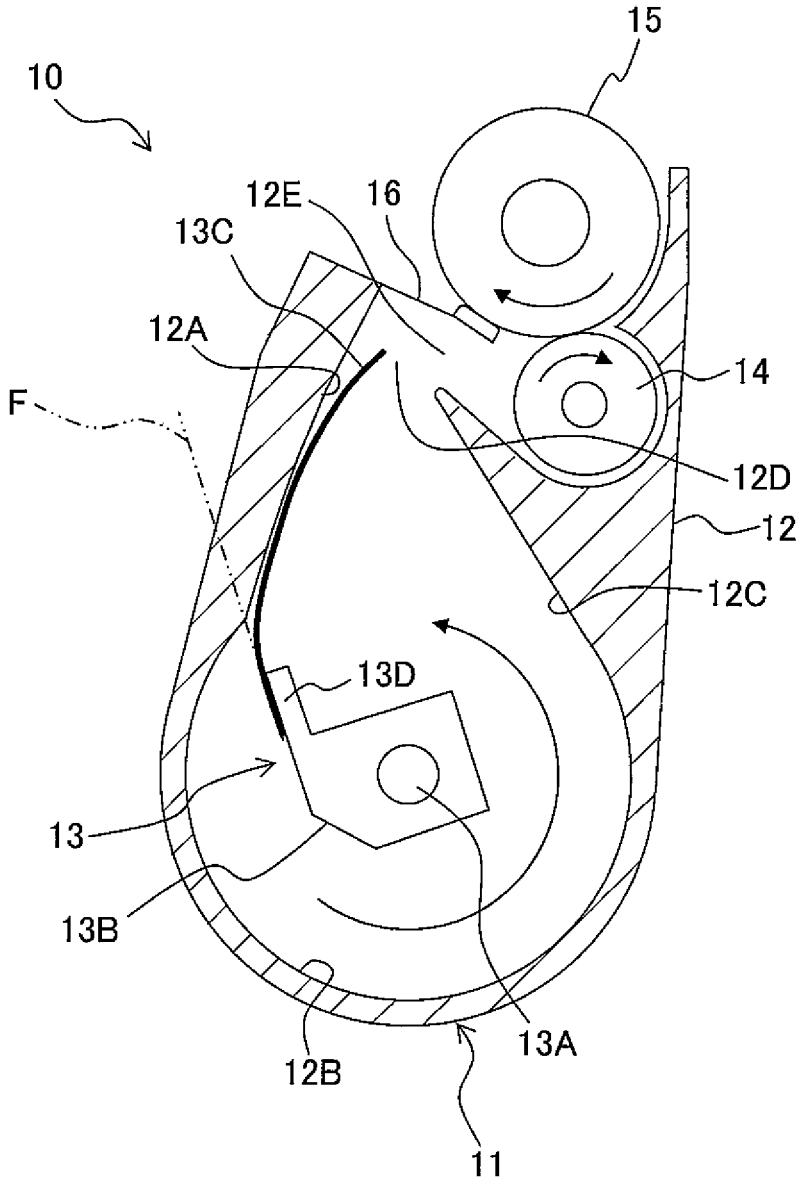
FIG. 2 is a lateral sectional view of a developing cartridge, which includes the developer container as shown in FIG. 1, in a direction perpendicular to an axis direction.

As shown in FIG. 2 while being enlarged, the developing cartridge 10, which is an example of the developer container, includes a container body 12 in which unillustrated toner is contained, an agitator 13 which is an example of a developer delivery member provided at a lower part of the container body 12, a supply roller 14 provided at an upper part of the container body 12, a developing roller 15, a layer thickness-regulating blade 16, and the like.

<Structure of Developer Container>

The container body 12 is a container which has an opening formed at an upper portion thereof and is elongated in left and right directions. A cross-section of the container body 12 has, for example, a raindrop shape. A colliding portion 12A is formed at the upper portion on the rear side (left side) of the inner wall of the container body 12; a slide flat-surface portion 12C is formed at the upper portion on the front side (right side) of the inner wall of the container body 12; and a slide curved-surface portion 12B which is continuous to the colliding portion 12A and the slide flat-surface portion 12C is formed at the lower portion of the inner wall of the container body 12. A developer delivery chamber 12D is formed at a space between the slide flat-surface portion 12C and the colliding portion 12A. A developer delivery opening 12E is open on the upstream side of the developer delivery chamber 12D.

The colliding portion 12A of the container body 12 is a wall surface against which an agitator body 13C of the agitator 13 as will be described later on collides in a swing or rotating direction. Here, a virtual plane, which is a plane when the agitator body 13C is elastically restored to a free state, is defined as a free plane F. In this situation, the colliding portion 12A is formed along an included surface which is inclined at a predetermined angle from the free plane F toward the upstream side (front side) in the swing direction of the agitator body 13C, at a rotating position of a rotating base member 13B at the time of collision of the agitator body 13C with the colliding portion 12A.

The slide curved-surface portion 12B of the container body 12 is a wall surface in a curved surface shape. The agitator body 13C elastically contacts with the slide curved-surface portion 12B to move slidably in a state of being elastically curved toward the upstream side in the swing direction (rear side in a movement direction). The slide flat-surface portion 12C of the container body 12 is a wall surface in a flat surface. The agitator body 13C elastically contacts with the slide flat-surface portion 12C at the front-end portion thereof to move slidably in a state of being elastically curved toward the upstream side in the swing direction (rear side in the movement direction). The slide flat-surface portion 12C is inclined so that the upper portion thereof approaches to the colliding portion 12A.

The developer delivery chamber 12D of the container body 12 is a space in which the agitator body 13C, which is elastically curved toward the upstream side in the swing direction (rear side in the movement direction), swings to the colliding portion 12A while being restored elastically to the free state. In particular, the developer delivery chamber 12D is provided above the lower end of the developer delivery opening 12E (upper end of the slide flat-surface portion 12C). The developer delivery opening 12E is a delivery opening to deliver the toner from the developer delivery chamber 12D to the supply roller 14, and is formed to open at the upper portion of the slide flat-surface portion 12C on the upstream side of the colliding portion 12A in the swing direction of the agitator body 13C.

<Structure of Agitator>

The agitator 13 is a component which is driven to rotate so that unillustrated toner contained in the container body 12 is stirred to be delivered to the developer delivery opening 12E. The agitator 13 includes a rotational shaft 13A extending in a longitudinal direction of left-right directions of the container body 12, the rotating base member 13B configured to rotate together with the rotational shaft 13A, and the agitator body 13C of which base-end portion is fixed to the rotating base member 13B.

A fixing part 13D configured to fix the base-end portion of the agitator body 13C is provided to protrude in the circumferential surface of the rotating base member 13B. The base-end portion of the agitator body 13C is fixed and adhered to the front surface, of the fixing part 13D, facing the downstream side in the rotating direction with a double-faced adhesive tape etc.

The agitator body 13C is an example of a body of the developer delivery member. The agitator body 13C is formed as an elastic part in a form of a thin-plate which has the elastic restoring force by using an appropriate synthetic resin material such as polyethylene terephthalate (PET). The length of the agitator body 13C from the base-end portion to the front-end portion has a length to such an extent that the front-end portion of the agitator body 13C reaches the upper portion of the colliding portion 12A facing the developer delivery opening 12E as shown in FIG. 2.

As shown in FIG. 2, the supply roller 14 and the developing roller 15 are arranged in the vicinity of the developer delivery opening 12E positioned at the upper portion of the container body 12 so that the circumferential surfaces of the supply roller 14 and the developing roller 15 are arranged closely to each other. The supply roller 14 is configured to supply the toner adhered to the circumferential surface of the supply roller 14 to the circumferential surface of the developing roller 15. The supply roller 14 is disposed below the developing roller 15.

The rotating direction of each of the supply roller 14 and the developing roller 15 is a clockwise direction in an example as shown in FIG. 2. The supply roller 14 moves forward (rightward) and the developing roller 15 moves backward (leftward), which is opposite to the forward (rightward), at a position at which the circumferential surfaces of supply roller 14 and the developing roller 15 face each other. Accordingly, it is possible to supply the toner smoothly from the circumferential surface of the supply roller 14 to the circumferential surface of the developing roller 15.

The developing roller 15 is configured to carry the toner supplied from the supply roller 14 on the circumferential surface thereof and to supply the toner to the electrostatic latent image formed on the circumferential surface of the photosensitive drum 63 (see FIG. 1). The developing roller 15 is disposed at a position nearer to the front side of the lower side of the photosensitive drum 63.

The layer thickness-regulating blade 16 is configured to regulate a layer thickness of the toner, supplied from the circumferential surface of the supply roller 14 to the circumferential surface of the developing roller 15 and carried by the circumferential surface of the developing roller 15. The base-end portion of the layer thickness-regulating blade 16 is fixed to the upper portion of the rear side (left side) portion of the container body 12 in which the colliding portion 12A is formed. The front-end portion, of layer thickness-regulating blade 16, which protrudes frontward (rightward) from the base-end portion, makes contact with the circumferential surface on the lower side of the developing roller 15 rotating backward (leftward) to cope with the rotation direction of the developing roller 15.

Figure 3:
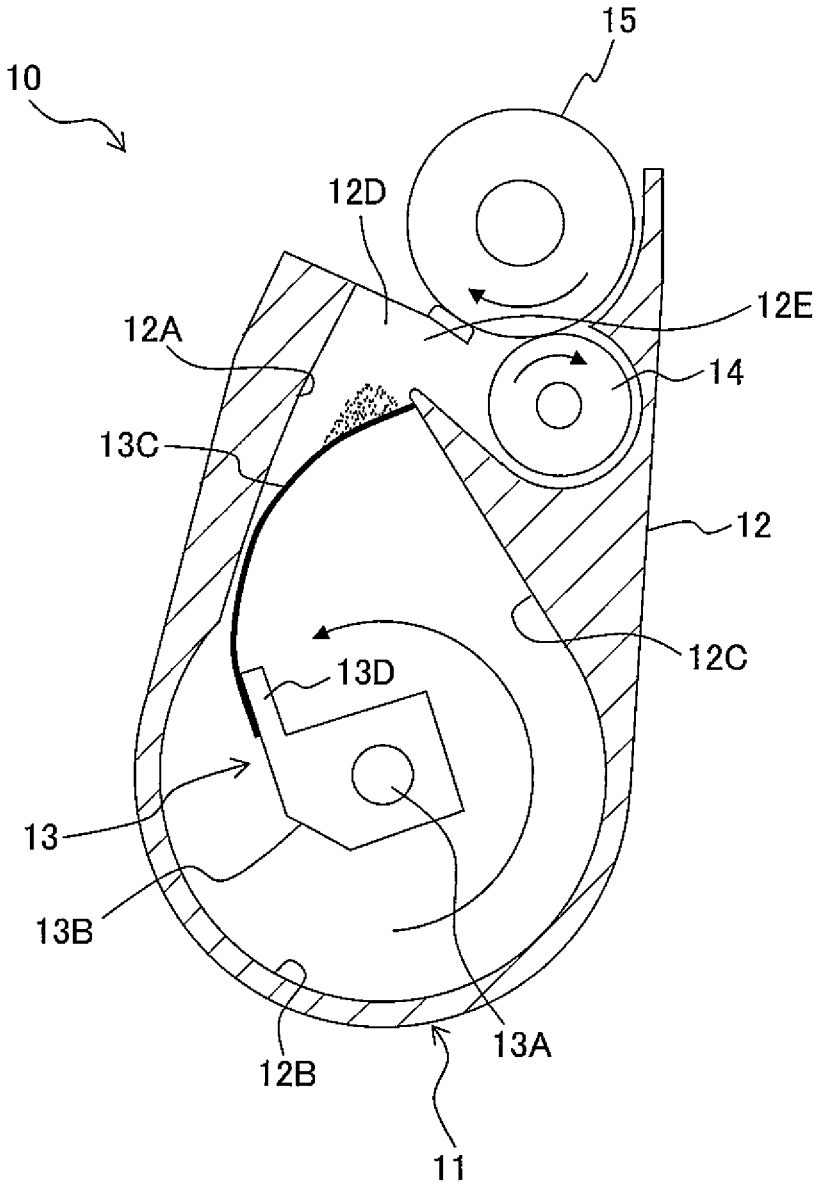
FIG. 3 is a diagram showing an action of swing or rotation of an agitator body as shown in FIG. 2 and showing a state in which a toner is delivered in the vicinity of a developer delivery opening.

In the developer container 11 of this embodiment configured as described above, as shown in FIG. 3, the rotating base member 13B of the agitator 13 rotates leftward (in a direction shown by the arrow) together with the rotational shaft 13A in the container body 12 and the agitator body 13C formed as the elastic part swings leftward (in the direction shown by the arrow) with the rotational shaft 13A as a center, thereby agitating the toner contained in the container body 12.

Figure 4:
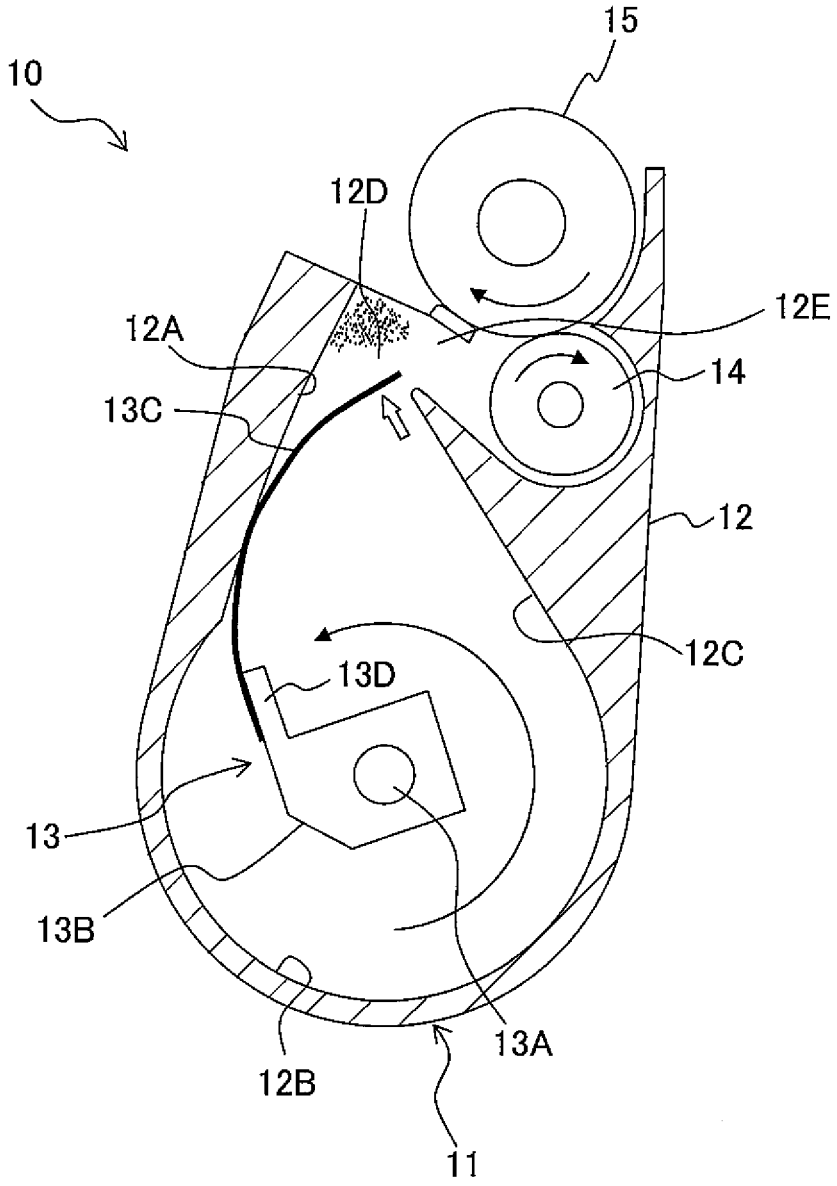
FIG. 4 is another diagram showing an action of swing or rotation of the agitator body as shown in FIG. 2 and showing a state in which the toner is released to a developer delivery chamber by the agitator body.
Figure 5:
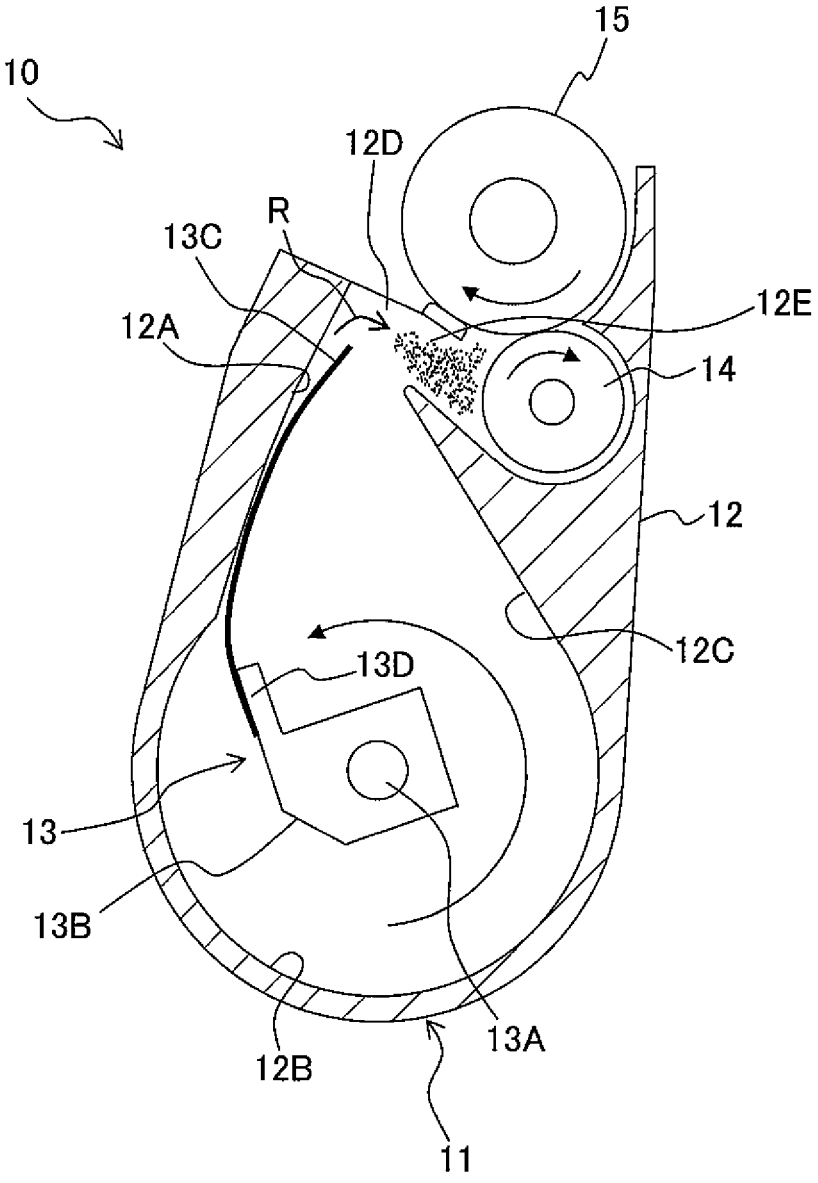
FIG. 5 is still another diagram showing an action of swing or rotation of the agitator body as shown in FIG. 2 and showing a state in which the toner is delivered to the developer delivery opening by air flow to deliver the toner.

The agitator body 13C swinging leftward (in the direction shown by the arrow) moves slidably along the slide curved-surface portion 12B and the slide flat-surface portion 12C of the container body 12 in a state of being elastically curved toward the upstream side in the swing direction (rear side in the movement direction). Then, as shown in FIG. 4, the agitator body 13C releases the toner into the developer delivery chamber 12D while being restored elastically to the free state having a flat plate-shape in the developer delivery chamber 12D due to the elastic restoring force, and as shown in FIG. 5, the agitator body 13C further swings to collide with the colliding portion 12A. Accordingly, air flow to deliver the toner (delivery air flow R) is generated and the toner is delivered by the delivery air flow R toward the developer delivery opening 12E.

In this situation, the agitator body 13C colliding with the colliding portion 12A of the container body 12 collies with the colliding portion 12A to expel air between the agitator body 13C and the colliding portion 12A upward, and thereby generating a strong delivery air flow R which has high energy as the air flow to deliver the toner. As a result, a toner delivery capability for delivering the toner to the developer delivery opening 12E arranged above is improved.

As described above, according to the developer container 11 of this embodiment, by swinging the agitator body 13C in association with the rotation of the agitator 13, it is possible to generate the strong delivery air flow which has the high energy as the air flow to deliver the toner, and thus it is possible to improve the toner delivery capability of the agitator configured to deliver the toner to the developer delivery opening 12E arranged above. Further, it is possible to deliver the toner to the developer delivery opening 12E arranged above in a state that the toner is dispersed by the delivery air flow to be uniformized.

Figure 6:
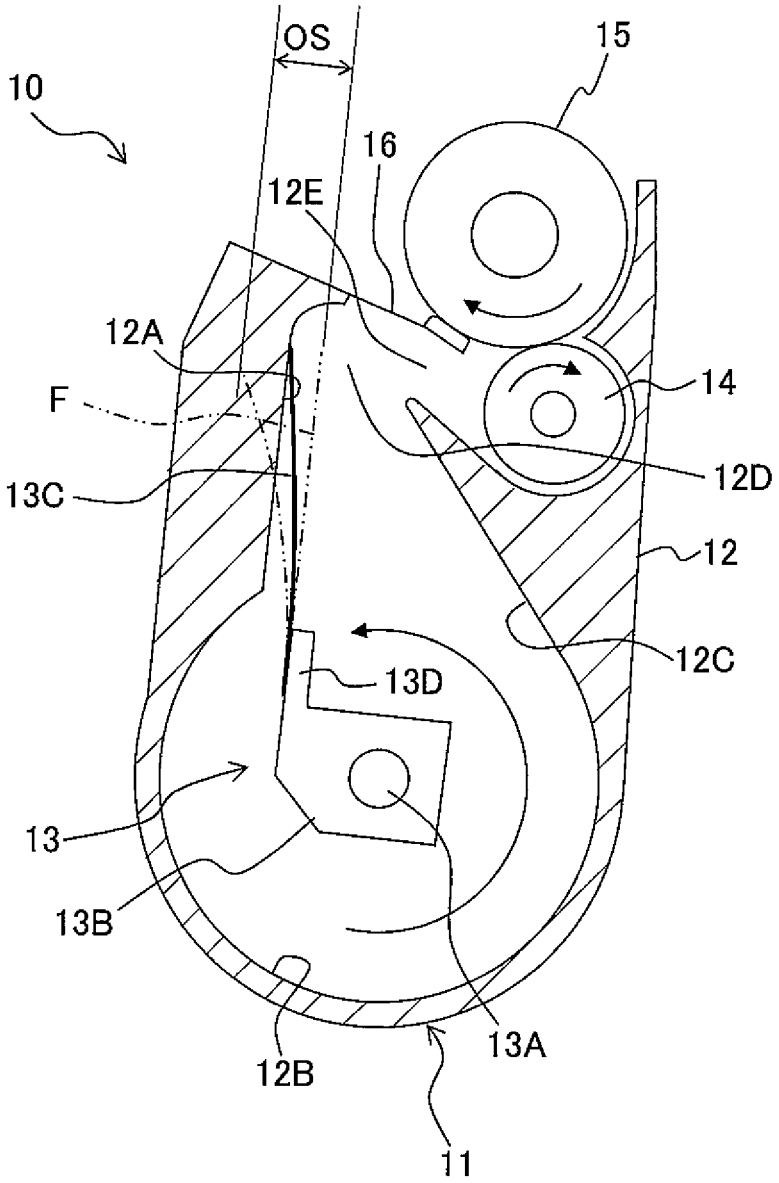
FIG. 6 is a lateral sectional view of a developing cartridge which corresponds to FIG. 2 and shows the first modified embodiment of the developer container.

In the above description, although the embodiment of the developer container according to the present teaching has been described, the developer container of the present teaching is not limited thereto. The structure of the developer container can be changed appropriately. For example, as shown in FIG. 6, the colliding portion 12A of the container body 12 may be formed parallel to the virtual free plane F, which is a plane when the agitator body 13C is elastically restored to the free state having the flat plate-shape from the curved state, with a predetermined spacing distance on the downstream side in the swing direction of the agitator body 13C, at the rotating position of the rotating base member 13B at the time of the collision of the agitator body 13C with the colliding portion 12A. Alternately, the colliding portion 12A of the container body 12 may be formed to overlap with the virtual free plane F.

The predetermined distance provided when the colliding portion 12A is formed to be parallel to the virtual free plane F with the predetermined distance is preferably a spacing distance which is smaller than an overshoot amount OS from the virtual free plane F, which is the plane when the agitator body 13C is elastically restored from the curved state to the flat plate state. Thereby, the agitator body 13C collides with the colliding portion 12A reliably.

Figure 7:
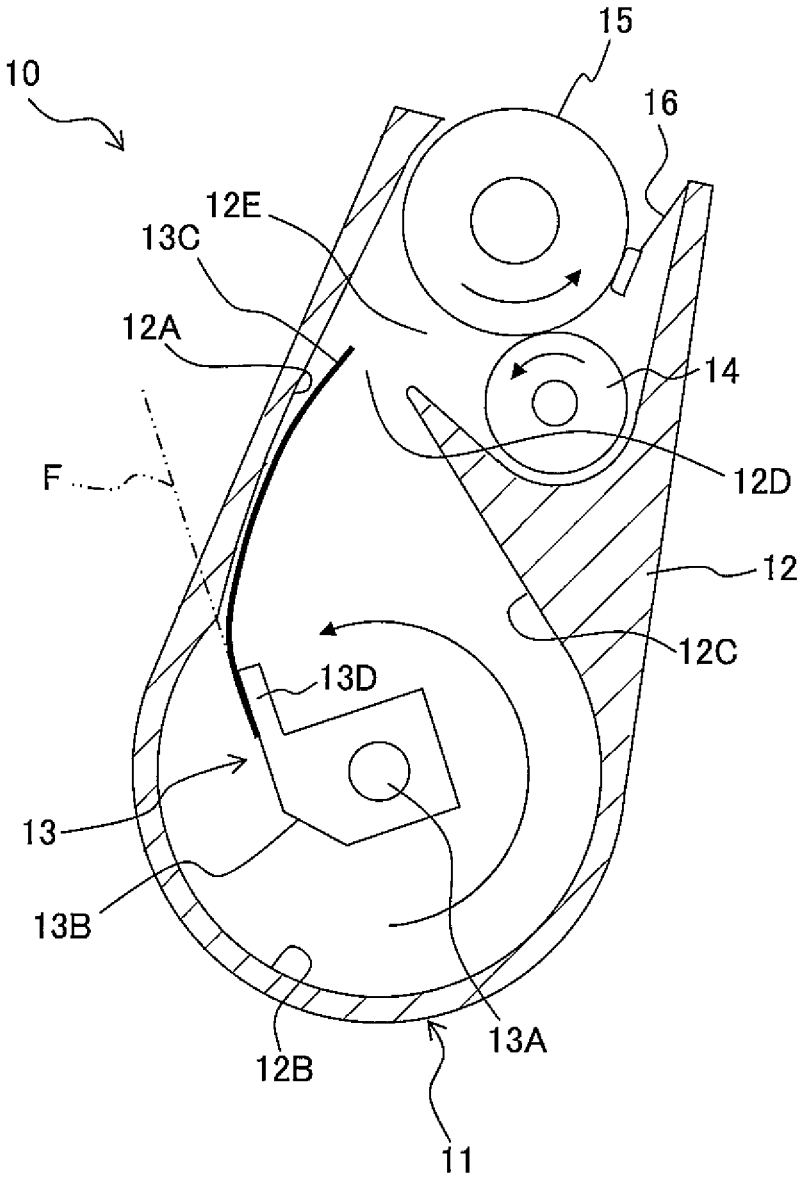
FIG. 7 is a lateral sectional view of a developing cartridge which corresponds to FIG. 2 and shows the second modified embodiment of the developer container.

As shown in FIG. 7, the following configuration is also allowable. That is, a space of a developing chamber is provided at the front side (right side) of the supply roller 14 and the developing roller 15 in the container body 12 and the layer thickness-regulating blade 16 is arranged in this space. In this case, it is preferable that the rotating direction of each of the supply roller 14 and the developing roller 15 is a counter-clockwise direction which is a direction opposite to the rotating direction of the example as shown in FIG. 2; that the base-end portion of the layer thickness-regulating blade 16 is fixed to the upper portion at the front side (right side) of the container body 12; and that the front-end portion, of the layer thickness-regulating blade 16, protruding rearward (leftward) from the base-end portion makes contact with the circumferential surface on the lower side of the developing roller 15 rotating forward (rightward) to cope with the rotation direction of the developing roller 15.

Further, in the embodiment, the rotational shaft 13A of the agitator 13 is arranged at the center of curvature of the slide curved-surface portion 12B. The rotational shaft 13A, however, may be arranged at a position which is eccentric from the center of curvature of the slide curved-surface portion 12B. For example, the rotational shaft 13A can be arranged eccentrically to a position closer to the slide flat-surface portion 12C. In this case, when the agitator body 13C slidably moves along the slide curved-surface portion 12B while being elastically curved, degree of curve of the agitator body 13C is increased gradually. Thus, the elastic restoring force generated when the agitator body 13C is elastically restored along the slide flat-surface portion 12C is increased, and thereby increasing an amount of the toner to be delivered by the agitator body 13C.

The developer container 11 of this embodiment is configured as a container placed vertically in which the toner is delivered upward by the agitator 13. The developer container of the present teaching, however, may be configured as a container placed horizontally in which the toner is delivered in the front and rear directions by the agitator.

The developer container of the present teaching may be configured as a toner cartridge, which is a separated member separated from the supply roller 14, the developing roller 15, and the layer thickness-regulating blade 16.

What is claimed is:

1. A developing unit of an image forming apparatus comprising:

a body defining a developing chamber and a developer accommodating chamber, the developing chamber being configured to accommodate a developing roller, and the developer accommodating chamber being configured to accommodate a developer and being connected to the developing chamber via a connection port, the body including a sliding portion, a restoring portion and a colliding portion at the developer accommodating chamber; and a developer delivery member arranged in the developer accommodating chamber and configured to rotate in a rotating direction so that the developer in the developer accommodating chamber is delivered to the developing chamber, the developer delivery member including an elastic member configured to be in sliding contact with the sliding portion while being curved elastically, configured to be restored elastically at the restoring portion, and configured to collide with the colliding portion, wherein the sliding portion, the restoring portion and the colliding portion are arranged along the rotating direction, the connection port is located on an upstream side of the colliding portion in the rotating direction, and the developer delivery member is configured so that the elastic member which has been elastically restored at the restoring portion is collided with the colliding portion to generate an air flow in a direction opposite the rotating direction and to deliver the developer in the developer accommodating chamber toward the connection port by the air flow in the direction opposite the rotating direction.

2. The developing unit according to claim 1, wherein the developer delivery member further includes a rotational axis, and a rotating base member configured to rotate on the rotational axis, the elastic member is fixed to the rotational base member, the colliding portion is formed along a virtual free plane, which is a plane in a case that the elastic member is elastically restored to a free state, at a rotating position of the rotating base member at the time of a collision of the elastic member with the colliding portion, or is formed along an included surface which is inclined at a predetermined angle from the virtual free plane toward an upstream side in the rotating direction of the elastic member.

3. The developing unit according to claim 1, wherein the developer delivery member further includes a rotational axis, and a rotating base member configured to rotate on the rotational axis, the elastic member is fixed to the rotational base member, the colliding portion is formed parallel to a virtual free plane, which is a plane in a case that the elastic member is elastically restored to a free state, with a predetermined spacing distance on a downstream side in the rotating direction of the elastic member, at a rotating position of the rotating base member at the time of a collision of the elastic member with the colliding portion.

4. The developing unit according to claim 3, wherein the predetermined spacing distance is a spacing distance which is smaller than an overshoot amount from the virtual free plane, in the case that the elastic member is elastically restored from a curved state.

5. The developing unit according to claim 1, wherein a cross-section of the body with respect to a plane perpendicular to a rotational axis of the elastic member is formed in a raindrop shape.

6. The developing unit according to claim 1, wherein the connection port is arranged adjacent to an upper portion of the colliding portion, the elastic member is configured to have a length from a proximal-end portion to a distal-end portion such that the distal-end portion reaches the upper portion of the colliding portion.

7. A developing unit of an image forming apparatus comprising:

a body defining a developing chamber and a developer accommodating chamber, the developing chamber being configured to accommodate a developing roller, and the developer accommodating chamber being configured to accommodate a developer and being connected to the developing chamber via a connection port, the body including a sliding portion, a restoring portion and a colliding portion at the developer accommodating chamber; and a developer delivery member arranged in the developer accommodating chamber and configured to rotate in a rotating direction so that the developer in the developer accommodating chamber is delivered to the developing chamber, the developer delivery member including an elastic member configured to be in sliding contact with the sliding portion while being curved elastically, configured to be restored elastically at the restoring portion, and configured to collide with the colliding portion, wherein the sliding portion, the restoring portion and the colliding portion are arranged along the rotating direction, the connection port is located on an upstream side of the colliding portion in the rotating direction such that the colliding portion faces the connection port in a direction opposite the rotating direction, and the developer delivery member is configured so that the elastic member which has been elastically restored at the restoring portion is collided with the colliding portion to generate an air flow and to deliver the developer in the developer accommodating chamber toward the connection port.

8. The developing unit according to claim 7, wherein the developer delivery member further includes a rotational axis, and a rotating base member configured to rotate on the rotational axis, the elastic member is fixed to the rotational base member, and the colliding portion is formed along a virtual free plane, which is a plane in a case that the elastic member is elastically restored to a free state, at a rotating position of the rotating base member at the time of a collision of the elastic member with the colliding portion, or is formed along an included surface which is inclined at a predetermined angle from the virtual free plane toward an upstream side in the rotating direction of the elastic member.

9. The developing unit according to claim 7, wherein the developer delivery member further includes a rotational axis, and a rotating base member configured to rotate on the rotational axis, the elastic member is fixed to the rotational base member, the colliding portion is formed parallel to a virtual free plane, which is a plane in a case that the elastic member is elastically restored to a free state, with a predetermined spacing distance on a downstream side in the rotating direction of the elastic member, at a rotating position of the rotating base member at the time of a collision of the elastic member with the colliding portion.

10. The developing unit according to claim 9, wherein the predetermined spacing distance is a spacing distance which is smaller than an overshoot amount from the virtual free plane, in the case that the elastic member is elastically restored from a curved state.

11. The developing unit according to claim 7, wherein a cross-section of the body with respect to a plane perpendicular to a rotational axis of the elastic member is formed in a raindrop shape.

12. The developing unit according to claim 7, wherein the connection port is arranged adjacent to an upper portion of the colliding portion, the elastic member is configured to have a length from a proximal-end portion to a distal-end portion such that the distal-end portion reaches the upper portion of the colliding portion.

* * * * *